United States Patent [19]

Yang

[11] Patent Number: 4,834,354

[45] Date of Patent: May 30, 1989

[54] CLAMP STRUCTURES

[76] Inventor: Tai-Her Yang, 5-1 Taipin St., Si-Hu Town, Dzan-Hwa, Taiwan

[21] Appl. No.: 93,254

[22] Filed: Sep. 4, 1987

Related U.S. Application Data

[63] Continuation-in-part of Ser. No. 708,883, Mar. 6, 1985, Pat. No. 4,691,907.

[51] Int. Cl.[4] ..... B25B 1/00

[52] U.S. Cl. ..... 269/156; 269/249; 269/258

[58] Field of Search ..... 269/279–284, 269/249, 258, 152, 156, 41, 45, 88

[56] References Cited

U.S. PATENT DOCUMENTS 361,777 4/1887 Patten ..... 269/156

1,497,107 6/1924 Lasell ..... 269/156

2,941,557 6/1960 Baprawski ..... 269/41

FOREIGN PATENT DOCUMENTS 2593422 7/1987 France ..... 269/156

*Primary Examiner*—Robert C. Watson

*Attorney, Agent, or Firm*—Leonard Bloom

[57] ABSTRACT

A C-clamp is provided having L-shaped stationary members capable of being adjusted to a plurality of rigidly retained selectable orientations with respect to one another and capable of being rigidly secured to a shaft which supports a threaded movable member. A polygonal element on the shaft engages complementary polygonal holes in the L-shaped members to rigidly retain the selected orientation of the L-shaped members with respect to one another and the shaft.

10 Claims, 22 Drawing Sheets

CLAMP STRUCTURES

CROSS REFERENCE TO RELATED APPLICATIONS

This application is a continuation-in-part of co-pending application Ser. No. 708,883 filed Mar. 6, 1985, now U.S. Pat. No. 4,691,907, the disclosure of which is, by reference, incorporated herein in its entirety.

FIELD OF THE INVENTION

The invention relates to C-clamps for clamping a workpiece between a movable member and a stationary member.

BACKGROUND OF THE INVENTION

C-shaped clamps are generally used by workers for clamping two parts of a workpiece, or for fixing a workpiece on a work table for a processing machine in order to solder, drill, lathe, grind and mill the workpiece. A conventional C-shaped clamp generally includes a C-shaped main body and a screw which can be adjusted forward and backward, the front end of the screw possessing a movable top block. In use, a space between the top block and surface of inner side corresponding to C-shaped main body is used for receiving the workpiece. Then the screw is screwed to fix and clamp the workpiece. For workpieces whose shapes are not completely regular and planar, even if the front end of the screw of the conventional C-shaped clamp possesses a movable top block, it still cannot meet conventional C-shaped clamp multi-use requirements.

SUMMARY OF THE INVENTION

The present invention relates to an improved structure of C-shaped clamp, its main character is that C-shaped clamp possesses two support arms in which the relative angle between the support arms can be adjusted. On each support arm, there is a clamping block which can make rotary adjustment in order to clamp an irregular workpiece. In accordance with the invention, a C-clamp structure for clamping a workpiece is provided and includes a threaded movable member including a handle for rotating said movable member and a support shaft for supporting the movable member where the support shaft has a threaded pipe portion for receiving the movable member. The C-clamp structure also includes a pair of L-shaped stationary members including first portions extending in substantially parallel planes and including second portions extending substantially perpendicular to the first portions. The second portions have shafts for receiving clamping blocks. The clamping blocks are capable of rotating around the L-shaped member shaft portions to permit the blocks to engage the workpiece.

The support shaft includes means for rigidly engaging the L-shaped stationary members and for permitting the L-shaped stationary members to be selectively oriented in a rigid orientation with respect to one another. Preferably, the means for retaining said L-shaped stationary members in rigid engagement with the support shaft includes a threaded bottom portion of the support shaft and a complementarily threaded nut.

The support shaft also includes means for preventing the threaded pipe portion from rotating with respect to the rigidly oriented L-shaped stationary members. Preferably, the means for preventing the threaded pipe portion from rotating with respect to the rigidly oriented L-shaped stationary members includes rib means located on the support shaft and means for engaging the rib means.

The first portions of the L-shaped stationary members includes means for rigidly engaging the support shaft, the support shaft engaging means permitting the L-shaped stationary members to be rigidly retained in a selected orientation with respect to one another. The L-shaped stationary members are capable of being adjusted with respect to one another by being rotated around the support shaft by disengaging the means for retaining the support shaft in rigid engagement with the L-shaped stationary members, by rotating the L-shaped stationary members with respect to one another, and by re-engaging the means for rigidly engaging the support shaft and the L-shaped stationary members together.

Preferably, the support shaft includes a polygonal outer surface, and the means on the L-shaped stationary members for rigidly engaging the support shaft includes polygonal surfaces which complementarily engage the polygonal outer surface of the support shaft.

The L-shaped stationary members include second portions extending substantially perpendicular to the first portions. The second portions have shaft portions for receiving the clamping blocks.

In the preferred embodiment of the invention, a common securing means is used to secure both (a) the polygonal means that retain the L-shaped stationary members in a selected rigid orientation and (b) the ribs and rib engagers on the support shaft which prevent the threaded pipe portion from rotating with respect to the rigidly oriented L-shaped stationary members. The preferred common securing means includes a support shaft with a threaded bottom and a complementarily threaded nut.

In accordance with another aspect of the invention, a C-clamp is provided which includes a threaded movable member including a handle for rotating said movable member; and a unitary, integrally casted base including a triangular first base portion and three second base portions projecting perpendicularly from the first portion, where one of the second base portions includes a threaded pipe portion for receiving the movable member. Two of the second base portions include shaft portions for receiving clamping blocks. The clamping blocks are attached to the shaft portions of the second portions of the L-shaped stationary members. The clamping blocks are capable of rotating around the L-shaped member shaft portions to permit the blocks to engage the workpiece.

In accordance with yet another aspect of the invention, a C-clamp is provided wherein threaded rods that advance toward clamping blocks are fitted with freely rotatable swivel heads. More specifically, the preferred swivel head C-clamp includes a common base having forward and rearward ends, wherein the base has a slot formed therein for facilitating mounting the base on a support. A first pair of substantially-parallel supports is formed integrally with the forward end of the base transversely thereof. Each of the supports is non-movable relative to one another and has a threaded hole formed therein along an axis substantially transverse thereto. A threaded rod passes through each hole, the rods having respective longitudinal axes and extending substantially parallel to each other and to the slot of the base. The rods have respective forward and rearward end portions. The forward end portion of each rod extends forwardly beyond the respective upstanding support. A crank handle is pivotably carried by the extending forward end portion of each rod, the handle being pivotable a full 180 degrees.

A clamping head is carried by the rearward end of each rod, the clamping heads including freely rotatable swivel heads.

A second pair of substantially-parallel spaced-apart upwardly extending supports is formed integrally with the rearward end of the base transversely thereof. Each second support has a respective end portion. Each respective end portion is provided with a shaft thereon. Each of the shafts has a respective longitudinal axis extending substantially parallel to the other respective longitudinal axis and perpendicular to the longitudinal axes of the threaded rods. A freely rotatable clamping block is carried on each respective shaft end of each respective second support. Each clamping block is substantially uniformly polygonal in cross-section and has a plurality of faces.

Each swivel head is freely rotatable on each rod independently of one another and may be automatically angularly adjusted by a workpiece being clamped in the C-clamp and being spaced from the other. Each clamping block is spaced from the other and is freely rotatable on its respective second support independently of one another and may be automatically angularly adjusted by a workpiece being clamped relative to its respective second support about an axis substantially perpendicular to the longitudinal axis of its respective threaded rod, thereby facilitating the clamping of an irregularly-shaped workpiece in the C-clamp structure. Each swivel head is rotatably retained on one of the rods and each clamping block is rotatably retained on one of the shafts by a retaining means which permits free rotation of the clamp block by the workpiece.

DESCRIPTION OF THE PREFERRED EMBODIMENT

Figure 1:
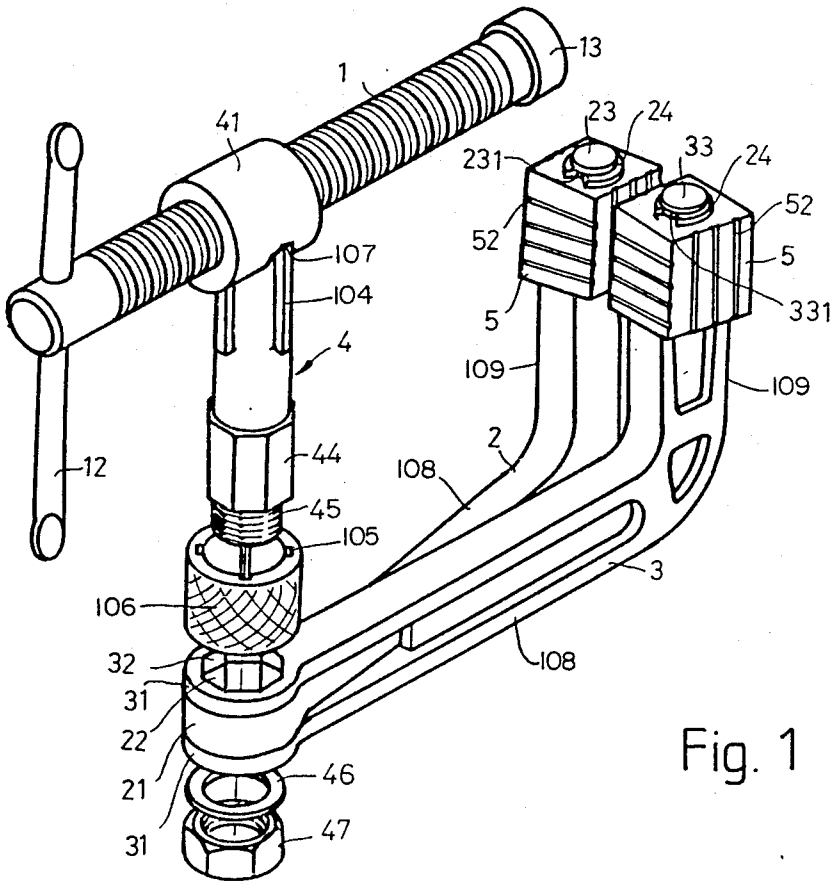
FIG. 1 is a partially exploded perspective view of the structure of the present invention having two rotatable and angularly adjustable support arms associated with a clamping block which can be adjusted by being rotated.
Figure 3:
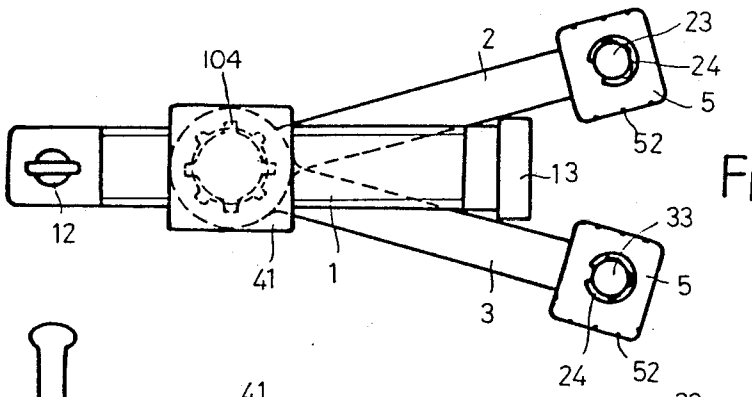
FIG. 3 is a top elevational view of the structure as shown in FIG. 1.
Figure 2:
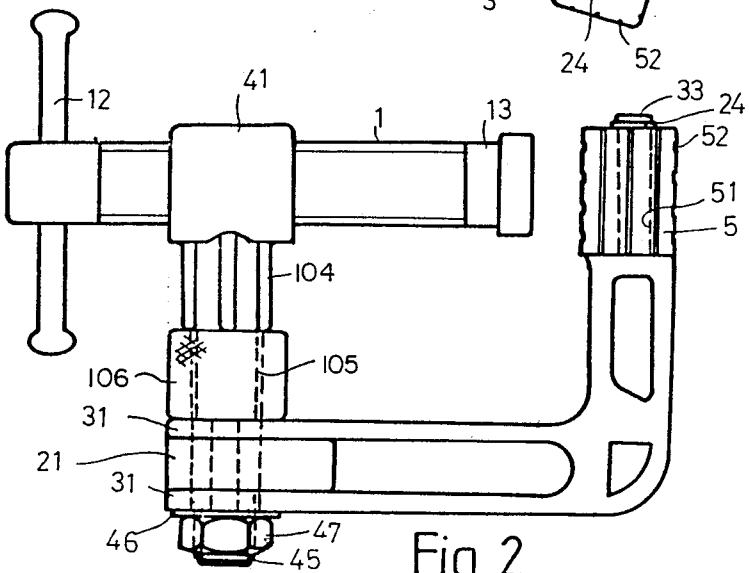
FIG. 2 is a front elevational view of the structure as shown in FIG. 1.
Figure 4:
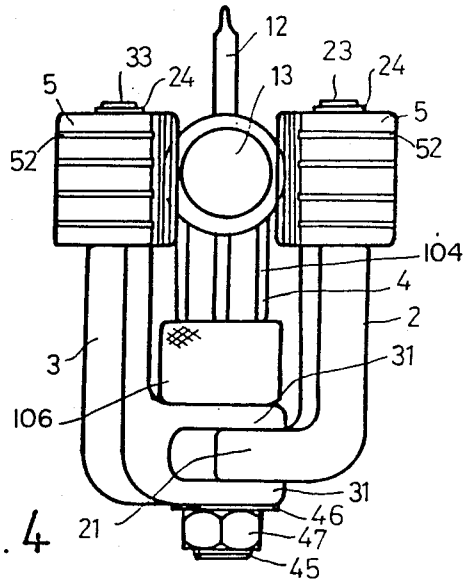
FIG. 4 is a side elevational view of the structure as shown in FIG. 1.
Figure 5:
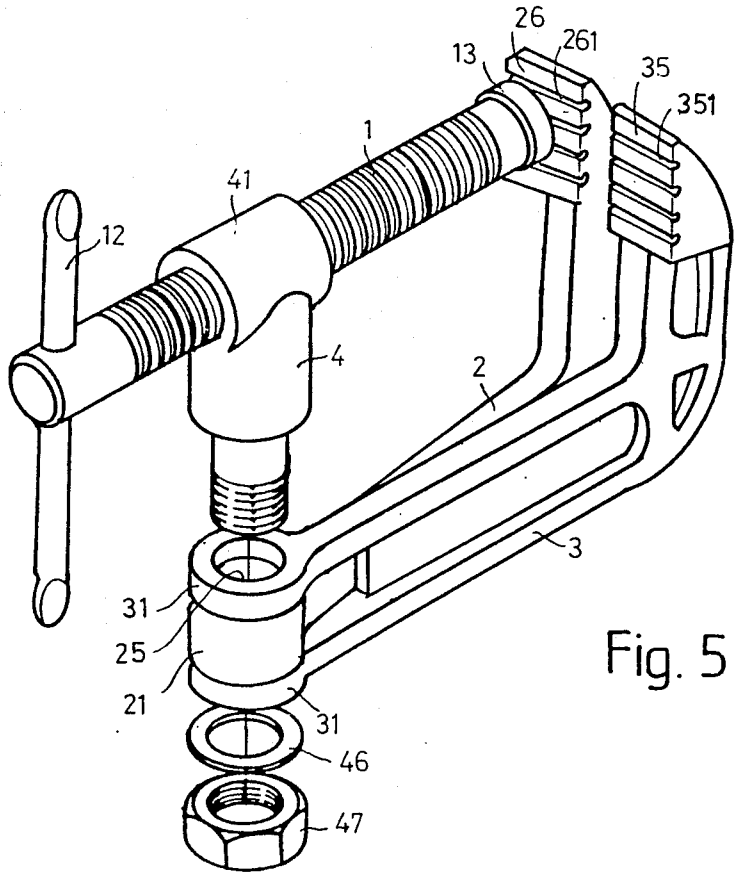
FIG. 5 is a perspective graphic view of the structure of the present invention having structure of two angle adjustable support arms.
Figure 8:
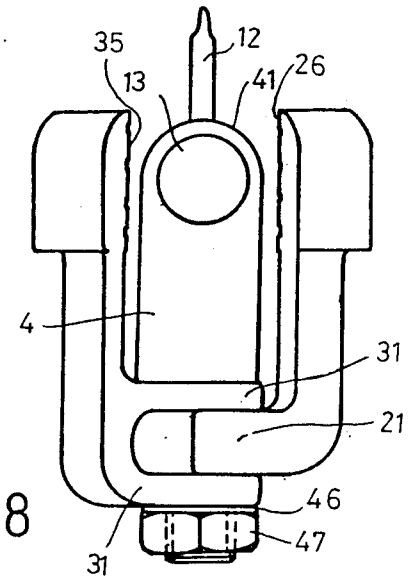
FIG. 8 is a side elevational view of the structure as shown in FIG. 5.
Figure 7:
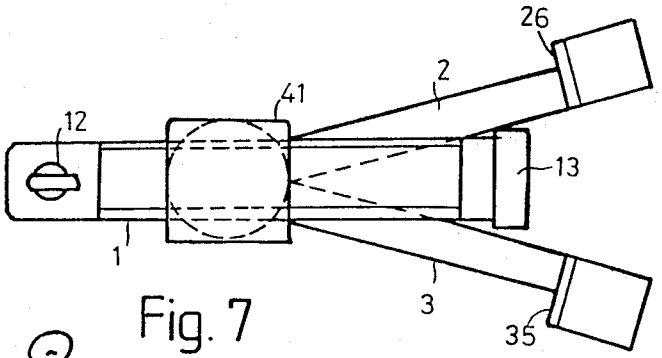
FIG. 7 is a top elevational view of the structure as shown in FIG. 5.
Figure 6:
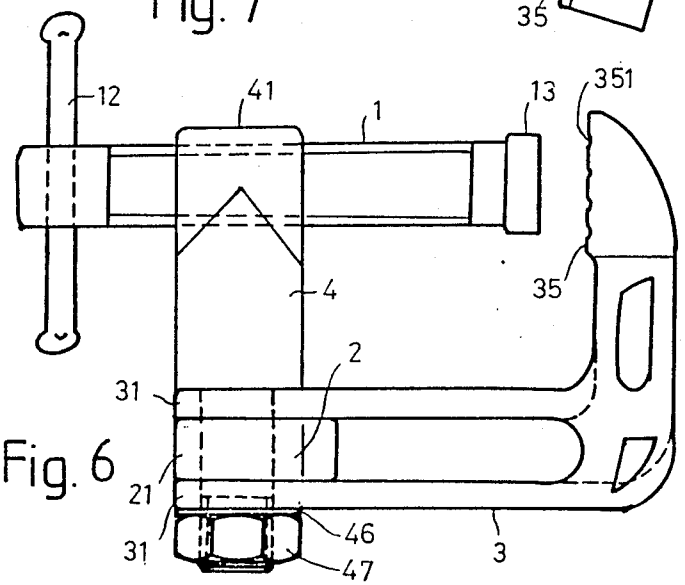
FIG. 6 is a front elevational view of the structure as shown in FIG. 5.
Figure 9:
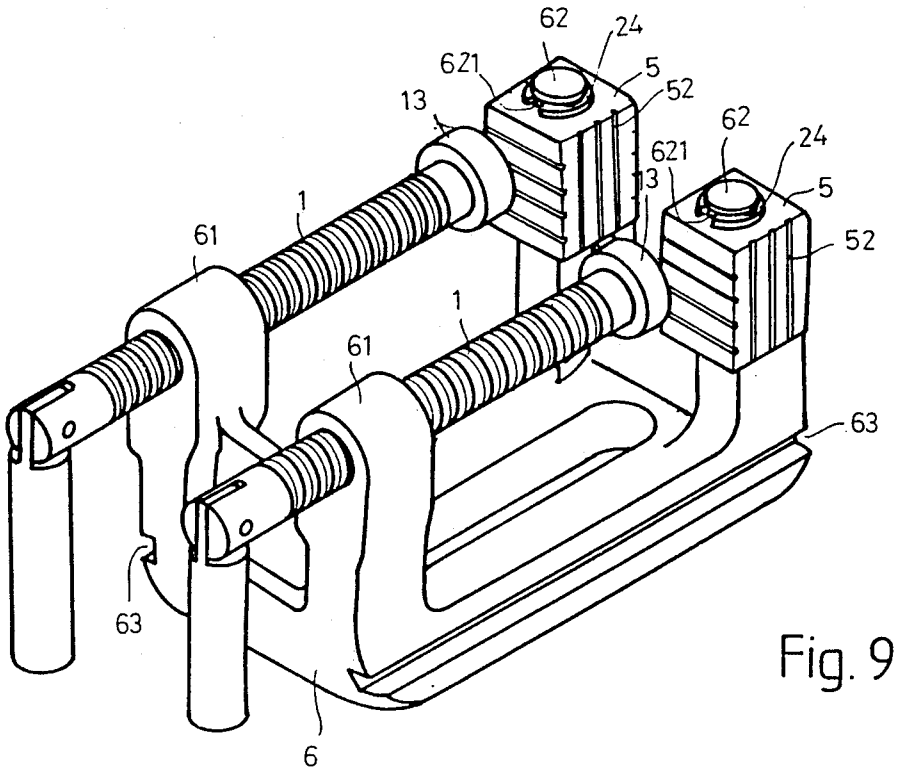
FIG. 9 is a perspective graphic view of the structure of the present invention having double screw and double support arm.
Figure 11:
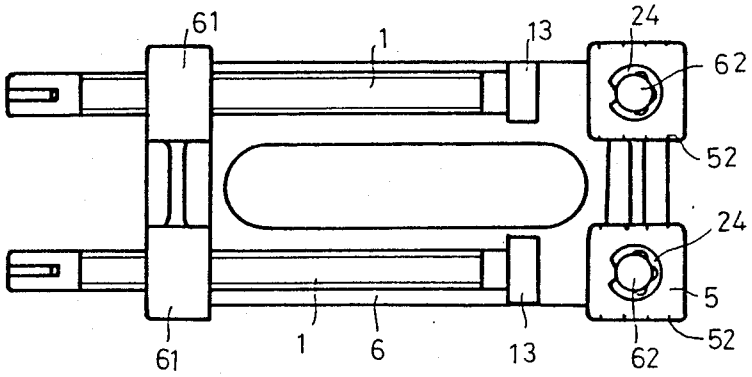
FIG. 11 is a top elevational view of the structure as shown in FIG. 9.
Figure 10:
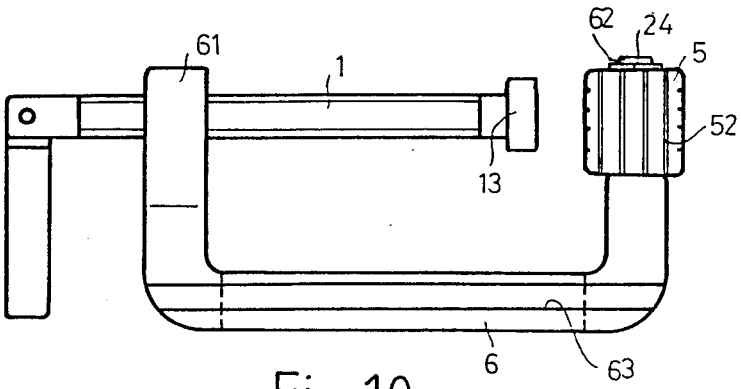
FIG. 10 is a front elevational view of the structure as shown in FIG. 9.
Figure 12:
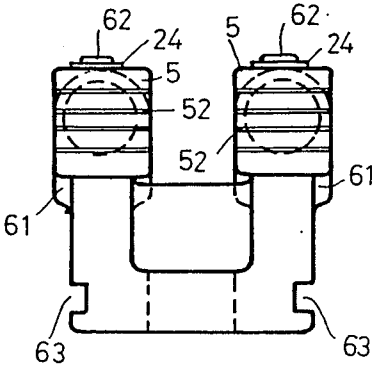
FIG. 12 is a side elevational view of the structure as shown in FIG. 9.
Figure 13:
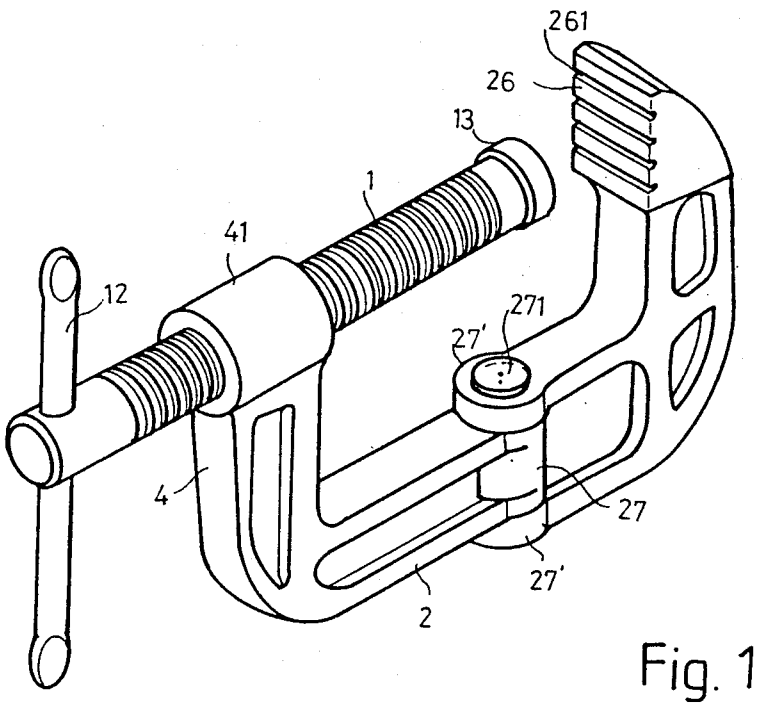
FIG. 13 is a perspective graphic view of the structure of the present invention having movable connection apparatus in the middle section of support arm.
Figure 16:
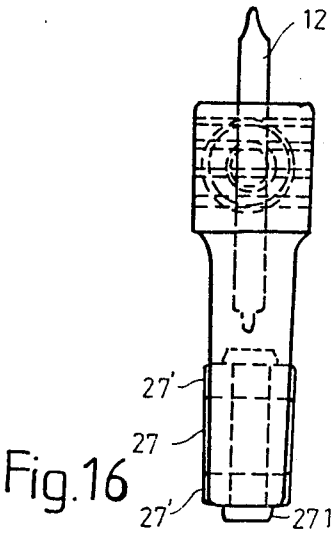
FIG. 16 is a side elevational view of the structure as shown in FIG. 13.
Figure 15:
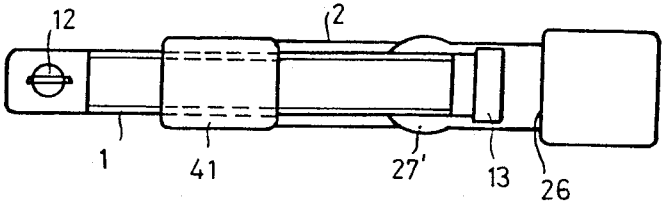
FIG. 15 is a top elevational view of the structure as shown in FIG. 13.
Figure 14:
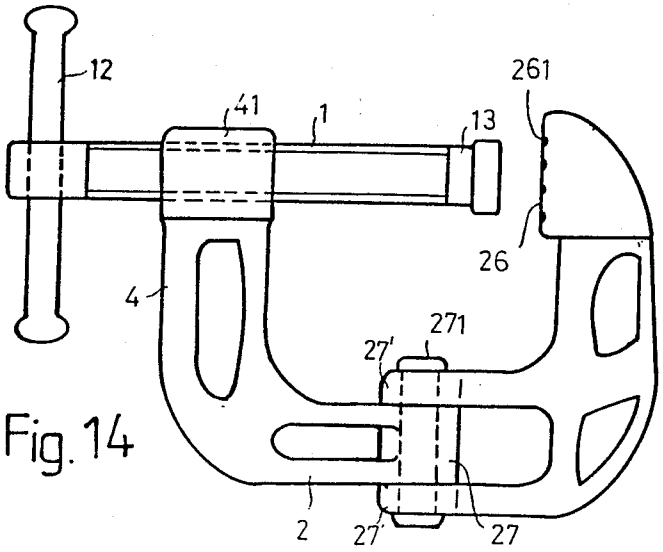
FIG. 14 is a front elevational view of the structure as shown in FIG. 13.
Figure 17:
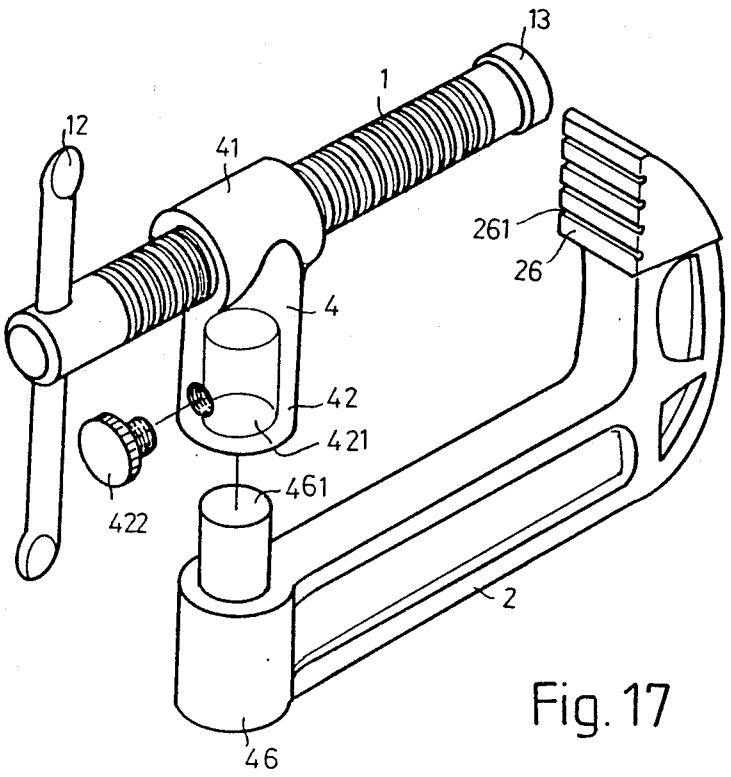
FIG. 17 is a perspective graphic view of the structure of the present invention in which screw support shaft is sectional type and it can make angular adjusting and setting work by the fixing screw.
Figure 20:
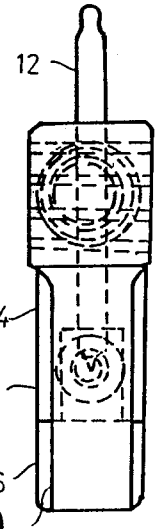
FIG. 20 is a side elevational view of the structure as shown in FIG. 17.
Figure 19:
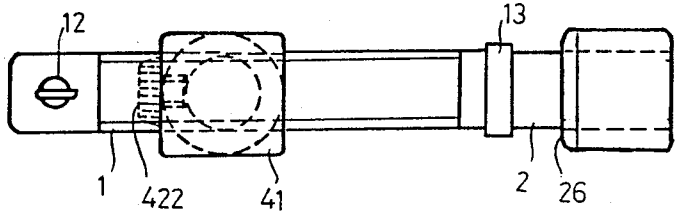
FIG. 19 is a top elevational view of the structure as shown in FIG. 17.
Figure 18:
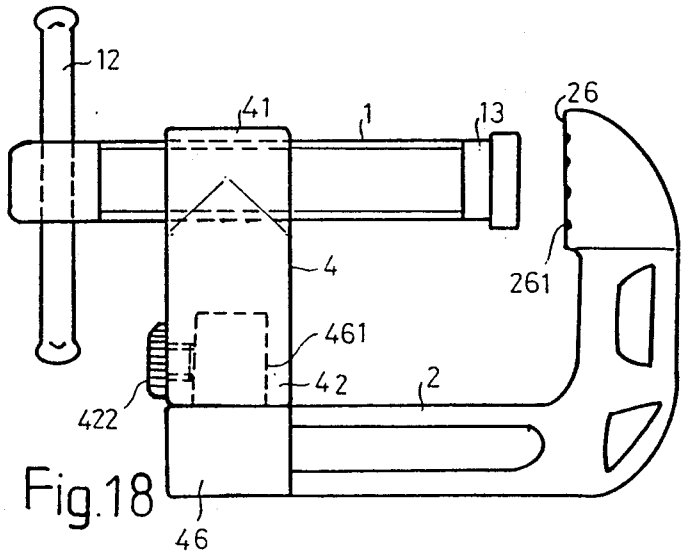
FIG. 18 is a front elevational view of the structure as shown in FIG. 17.
Figure 21:
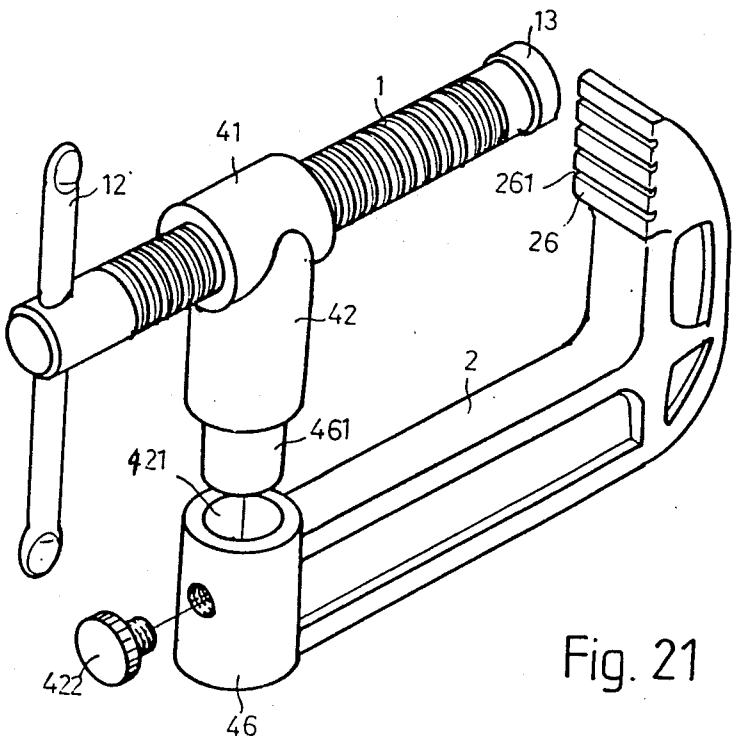
FIG. 21 is a perspective graphic view of another embodiment of the structure as shown in FIG. 17.
Figure 24:
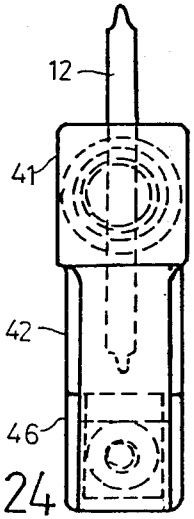
FIG. 24 is a side elevational view of the structure as shown in FIG. 21.
Figure 23:
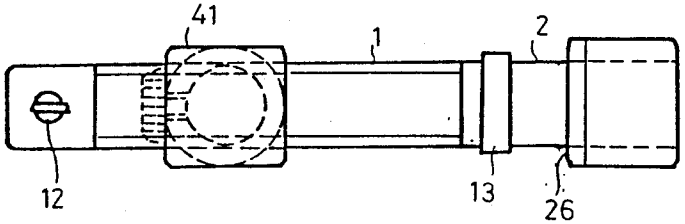
FIG. 23 is a top elevational view of the structure as shown in FIG. 21.
Figure 22:
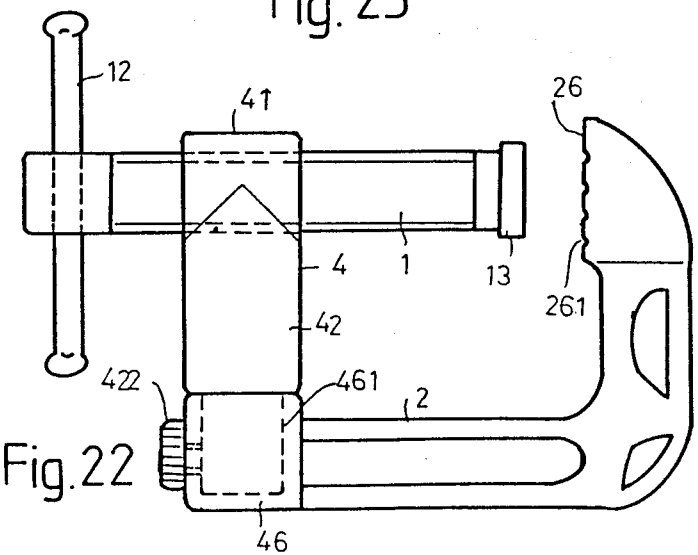
FIG. 22 is a front elevational view of the structure as shown in FIG. 21.
Figure 25:
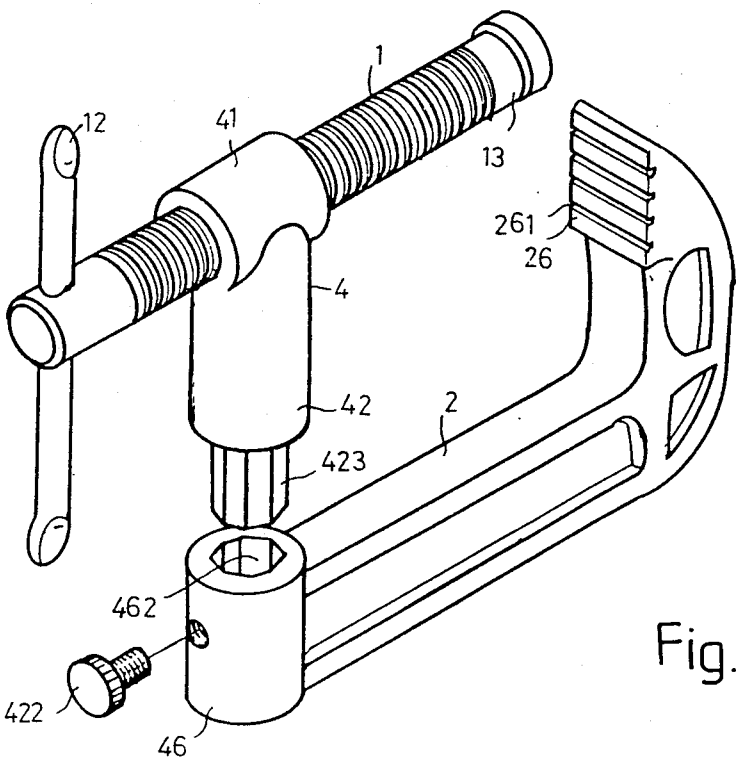
FIG. 25 is a perspective graphic view of the structure of the present invention in which screw support shaft is sectional type and it can make angular adjusting and setting work by polygonal support shaft and shaft hole.
Figure 28:
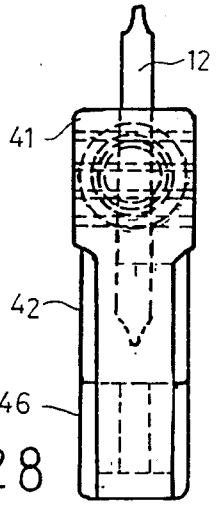
FIG. 28 is a side elevational view of the structure as shown in FIG. 25.
Figure 27:
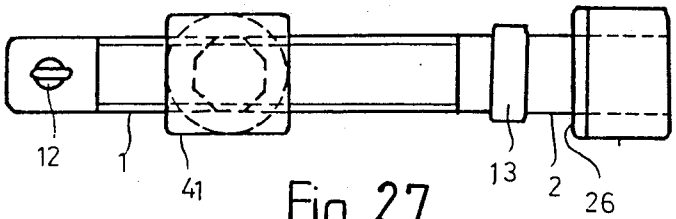
FIG. 27 is a top elevational view of the structure as shown in FIG. 25.
Figure 26:
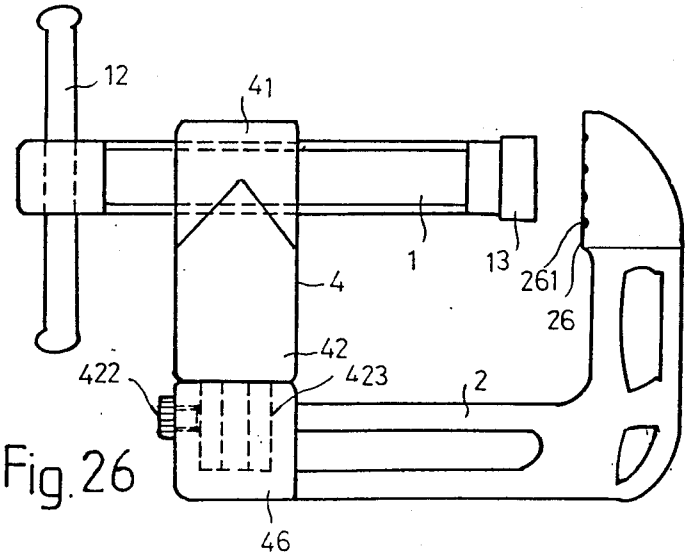
FIG. 26 is a front elevational view of the structure as shown in FIG. 25.
Figure 29:
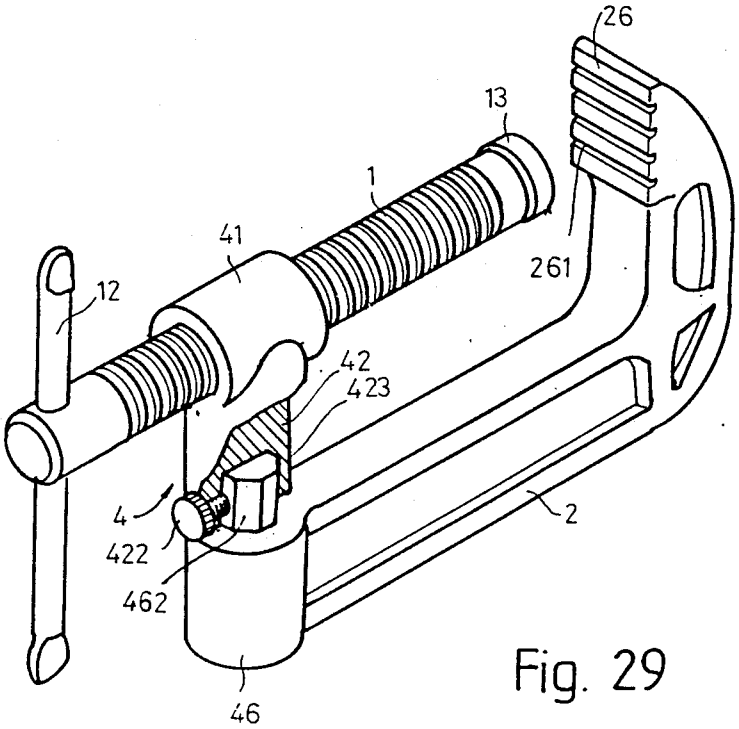
FIG. 29 is a perspective graphic view of another embodiment of the structure as shown in FIG. 25.
Figure 32:
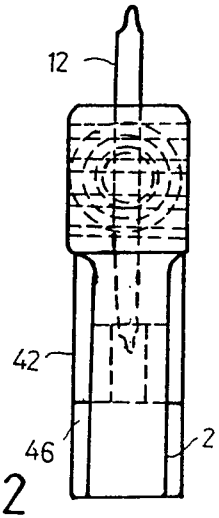
FIG. 32 is a side elevational view of the structure as shown in FIG. 29.
Figure 31:
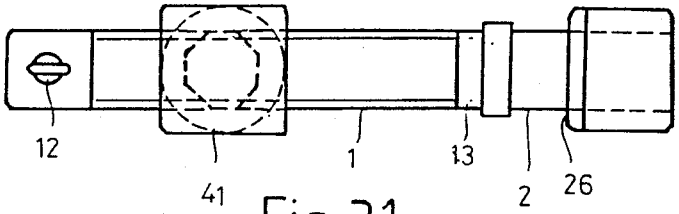
FIG. 31 is a top elevational view of the structure as shown in FIG. 29.
Figure 30:
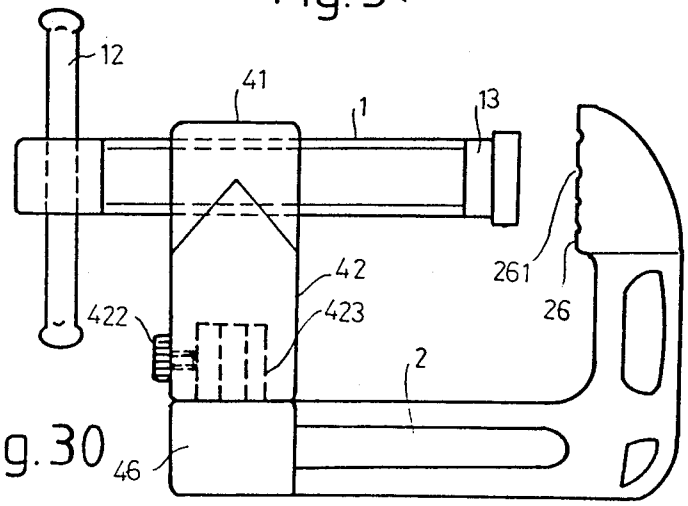
FIG. 30 is a front elevational view of the structure as shown in FIG. 29.
Figure 33:
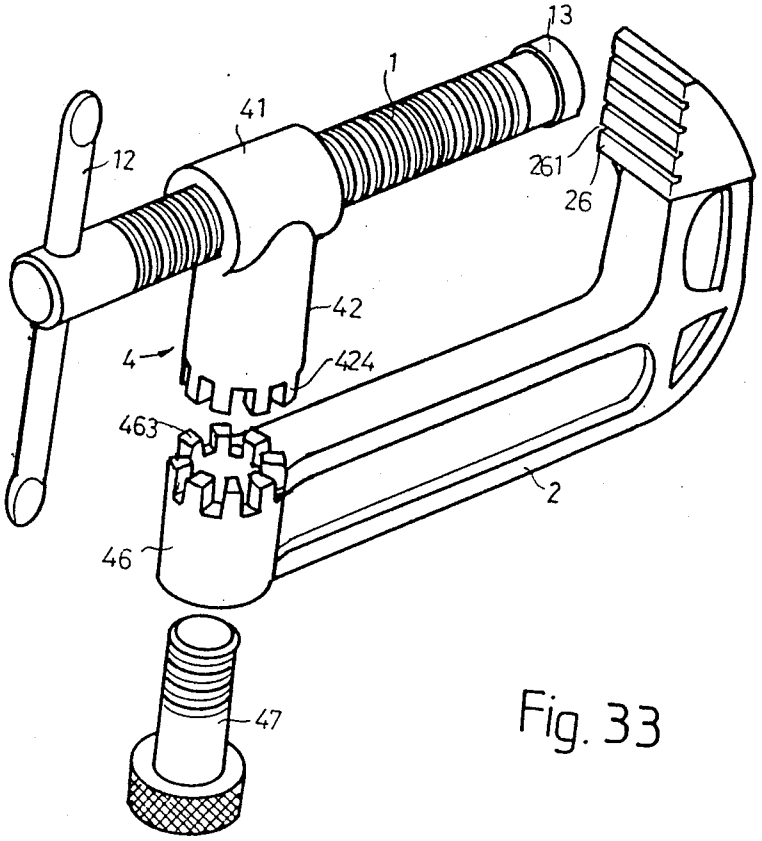
FIG. 33 is a perspective graphic view of the structure of the present invention in which support shaft is double sectional type and it can make angular adjusting and setting work by toothed slot.
Figure 36:
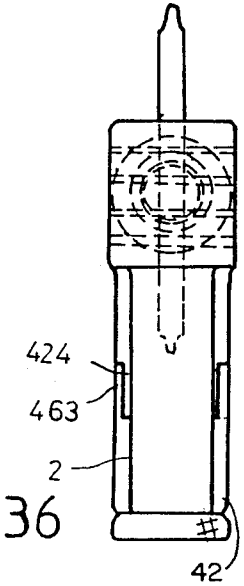
FIG. 36 is a side elevational view of the structure as shown in FIG. 33.
Figure 35:
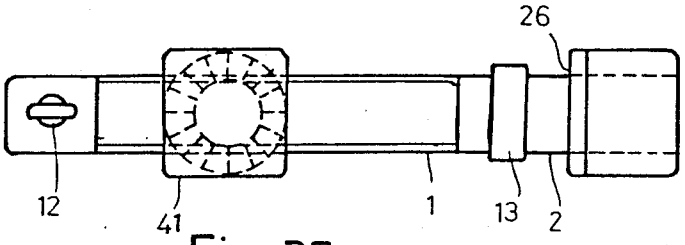
FIG. 35 is a top elevational view of the structure as shown in FIG. 33.
Figure 34:
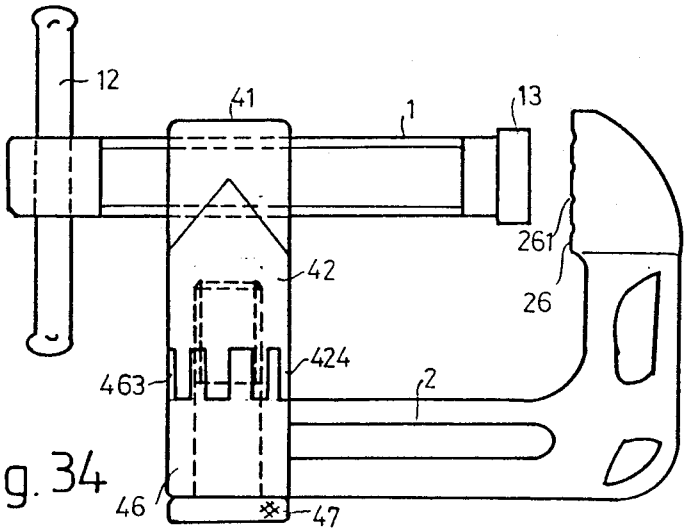
FIG. 34 is a front elevational view of the structure as shown in FIG. 33.
Figure 37:
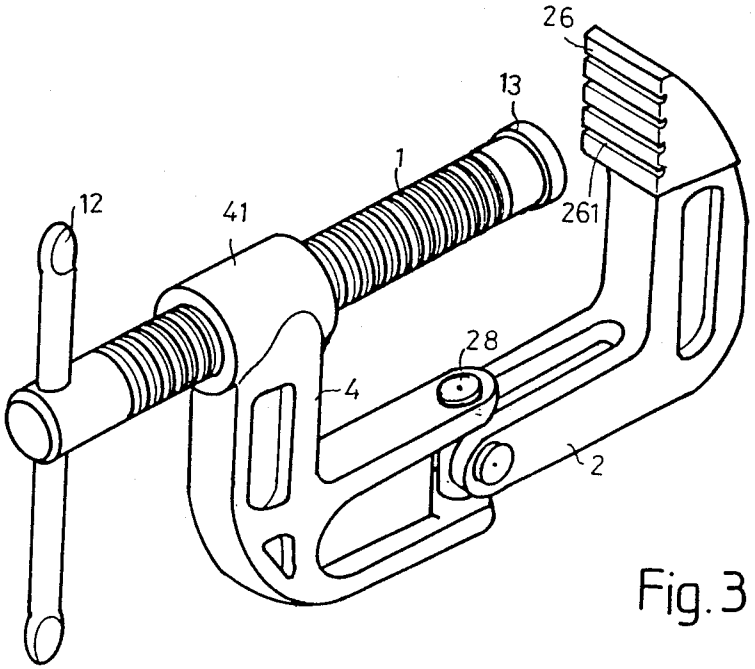
FIG. 37 is a perspective graphic view f the structure of the present invention having universal connection apparatus in the middle section of support arm.
Figure 40:
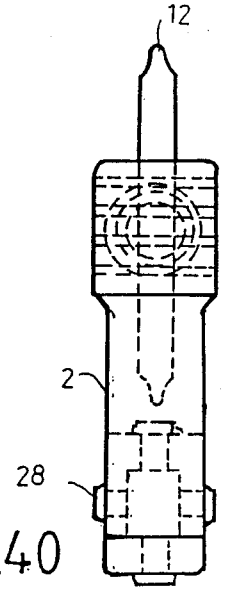
FIG. 40 is a side elevational view of the structure as shown in FIG. 37.
Figure 39:
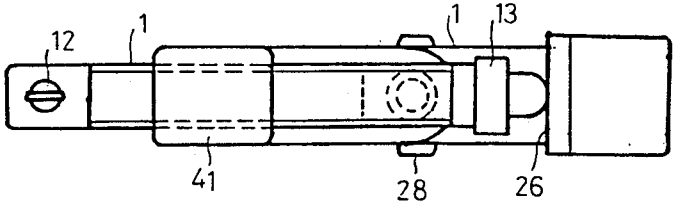
FIG. 39 is a top elevational view of the structure as shown in FIG. 37.
Figure 38:
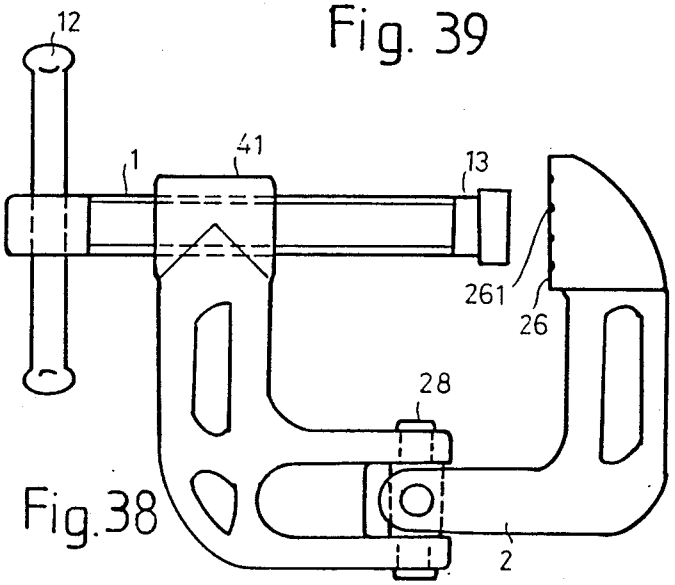
FIG. 38 is a front elevational view of the structure as shown in FIG. 37.

The present invention relates to improvements in C-shaped clamp structure, and it is researched and designed to meet the above-mentioned requirement of use. The provided practical structures of the invention can obtain the desired clamping function and promote the use of C-shaped clamps in the multiple situations.

A preferred embodiment of structure of the present invention will now be described as follows in detail with reference to the examples thereof as illustrated in the accompanying drawings.

As shown in FIGS. 1–4, C-shaped clamp of the present invention mainly comprises elements of a threaded movable member of screw threaded rod (1), two L-shaped stationary members or support arms (2), (3) and screw support shaft (4). The screw (1) is assembled to penetrate through upper screw pipe constituting an internally-threaded sleeve (41) of above screw support shaft (4). At one end of the screw (1), there is handle rod (12) for applying force, at another end, there is movable top block (13) constituting a clamping means. The movable top block (13) can automatically adjust to match the clamping work in accordance with the design of the contact surface of the workpiece. The lower end of screw support shaft (4) is ladder type. The middle or intermediate section (44) has a polygonal shape, and its tail end (45) is threaded. The polygonal middle section (44) is used to rigidly engage the L-shaped stationary members (2), (3) to permit said L-shaped members to be selectively oriented in a rigid orientation with respect to one another.

The support shaft (4) also includes ribs (104) for preventing threaded pipe portion (41) from rotating with respect to the rigidly oriented L-shaped stationary members. The ribs (104) engage complementary slots (105) in lock nut (106) and other complementary slots (107) in the body of threaded pipe portion (41).

The pair of L-shaped stationary members or arms include first portions (108) extending in substantially parallel planes. The first portions of the L-shaped stationary members include concentric polygonal joint holes or sockets (32) for rigidly engaging the support shaft (4). The joint holes (32) permit the L-shaped stationary members (2), (3) to be rigidly retained in a selected orientation with respect to one another by means of polygonal middle section (44) of the support shaft (4).

The L-shaped stationary members are capable of being adjusted with respect to one another by being rotated around the support shaft by disengaging the polygonal joint holes (32) from the polygonal middle section (44), by rotating the L-shaped stationary members with respect to one another, and by re-engaging the holes (32) with the middle section (44).

The L-shaped stationary members include second portions (109) extending substantially perpendicular to first portions. The second portions (109) have shaft portions (23), (33) for receiving clamping blocks (5) which have central holes (51). The clamping blocks (5) are capable of freely rotating around the shaft portions (23), (33) to permit the blocks to engage the workpiece. The shaft portions (23), (33) have a ringed groove (231) for receiving lock washers (24) to retain the blocks (5) on the shaft portions (23), (33).

The clamp blocks (5) can have parallel grooves (52) to increase gripping ability of the workpiece.

In the embodiment shown in FIG. 1, L-shaped stationary member (2) has joint portion (21) which is sandwiched between L-shaped stationary member (3) bifurcated joint portion (31) as shown more clearly in FIG. 1. Each joint portion (21), (31) has a polygonal inner hole (32) for engaging polygonal middle (44) of the shaft (4).

Preferably, the shaft (4) has a bottom portion (45) which is threaded and complementarily engages threaded nut (47). Washer (46) is placed adjacent to nut (47). To reorient the L-shaped stationary members (2), (3) with respect to one another or to remove or replace the threaded pipe portion (41), the nut (47) is removed from the threaded portion (45), and the shaft (4) and members (2), (3) are disassembled as shown in the partially exploded view of FIG. 1. After reorientations of the members (2), (3), the shaft (4) and members (2), (3) are reassembled and the nut (47) is resecured.

As shown in FIGS. 5–8, it is another embodiment of the present invention, and the important difference between these two embodiments are that screw support shaft (4) is a design of circular diameter and possesses thread at lower end; on the joint portion (21), (31) of two support arms (2), (3), there is a circular central hole (25) for matching screw support shaft (4); another end of two support arms (2), (3), there is a circular central hole (25) for matching screw support shaft (4); another end of two support arms (2), (3) also respectively extends upward a suitable height and respectively forms fixed clamping surfaces (26), (35), and on each of clamping surfaces (26), (35), there are grooves lines (261), (351). Also in this design, screw nut (47) can be released to adjust angle between two support arms (2), (3) in order to obtain expected function of clamping the working piece tightly.

As shown in FIGS. 9–12, it is another structural design of above two embodiments, it relates to a clamping mechanism with double screw or threaded rod (1), and its main character is that one end of a common base (6) extends upward a proper height and forms a substantially-parallel double screw pipe or transverse support (61) on which is respectively used for a screw (1) to be received in a threaded hole therein and penetrate and couple between there; a handle is carried by the extending forward end portion of each rod. Another end of common base (6) also extends upward a proper height and assembles two central transverse supports having shafts (62), there respectively assembles a ring of ringed groove (621) for two clamping blocks (5) to couple in it respectively and have function of moving, rotating and adjusting about respective vertical axes. This kind of structural design can use two screws (1) to match two movable clamping blocks (5) in order to clamp larger or irregularly shaped working piece, its further character is to assemble joint slot (63) at bottom side of common base (6), through said joint slot (63), the present invention and the working table of processing machine can make expected fixing and joining work and obtain more multiple processing work.

Besides above embodiments, the present embodiment also supply the following several low cost mutually acceptable partial improved structures, one of them is as shown in FIGS. 13–16, it is suitable for C-shaped clamp in which the working piece possesses small incline, its character is that at the position of middle section of support arm (2), there are joint portions (27), (27') which are movably joined by a joint pin (271) to become a double sectional structure, one end of the fixed clamping surface (26) of support arm (2) can make deflective adjustment of small angle, it is suitable for clamping the working piece with small incline. As shown in FIGS. 17–20, it is another embodiment of structure of another C-shaped clamp which can make deflective adjustment, it is mainly characterized in that support shaft (4) of screw (1) is double sectional design, its upper section (42) assembles a shaft hole (421) in the central part, on the circumference, there is a fixed screw (422) to communicate with shaft hole (421); its lower section (46) is ladder type and possesses a central shaft (461), in combination central shaft (461) is placed in above shaft hole (421), the direction and angle of screw (1) are adjusted by releasing and locking the fixed screw (422) in order to clamp the required working piece. Structure as shown in FIGS. 21–24 is the contrary design of this kind of embodiment, that is, central shaft (461) is assembled on the upper section (42) of screw support shaft (4), shaft hole (421) is assembled in the central part of end section (46), fixed screw (422) is also changed to assemble on the circumference of end section (46), the obtained function is as same as above mentioned.

As shown in FIGS. 25–28, it is another embodiment of C-shaped clamp of the present invention, it is mainly characterized in that the upper section (42) of screw support shaft (4) is ladder type and possesses a polygonal central shaft (423), and in the central part of end section, there is a polygonal shaft hole (462) for matching each other, its can change the accepting angle of upper section (42) of polygonal support shaft and the above polygonal shaft hole (462), in order to obtain the above function of adjusting the clamping angle. FIGS. 29–32 are the contrary design of above embodiment, that is, at the upper section (42) of screw, there is a polygonal central shaft (423), also it can adjust the clamping angle of the present invention, in order to obtain the expected function of clamping the working piece. Both of these two embodiments use the combinative character of polygonal central shaft and polygonal shaft hole and can change the accepting angle without the locking apparatus and make the fixing and coupling work.

As shown in FIGS. 33–36, it is another embodiment of C-shaped clamp of the present invention which can adjust the clamping angle, its character is that screw support shaft (4) is double sectional design, at the corresponding end surface of upper section (42) and end section (46), there are the corresponding toothed slots (424), (463), and a fixed screw bolt (47) which can fix and lock upward, and the fixed screw bolt (47) is released to let the upper section (42) and lower section (46) of screw support shaft (4) separate from the engaged status, and further change the engaging angle of both of them, and then lock and fix the fixed screw bolt (47) in order to adjust the clamping angle of the C-shaped clamp of the present invention.

As shown in FIGS. 37–40, it is the other embodiment of C-shaped clamp of the present invention, its character is that support arm (2) divides into two sections in the middle sectional portion, and is linked by a universal joint (28), through the device of said universal joint (28), one end of fixed clamping surface (26) of support arm (2) can make various changes of different positions to match screw (1) and clamp various cubic irregular or little changed clamping surface working pieces, its application is more practical than above-mentioned embodiments.

Figure 41:
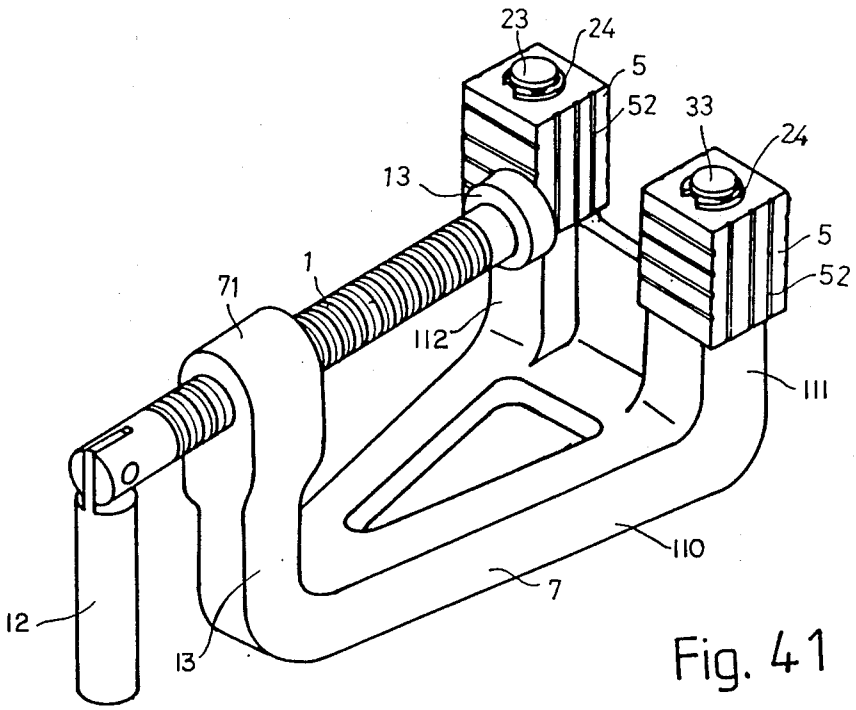
FIG. 41 is a perspective view of an embodiment having a fixed type single screw and fixed double support arm structure.

The embodiment shown in FIG. 1 can be further modified in a form of structure with a fixed angle of intersection, and FIG. 41 is the view of such an embodiment, which is formed by a C-shaped seat in an approximate triangle.

More specifically, with reference to FIG. 41, the C-clamp includes a threaded movable member (1) including a handle (12) for rotating the movable member. A unitary, integrally casted base (7) includes a triangular first base portion (110) and three second base portions (111), (112), (113) projecting perpendicularly from the first portion. One of the second base portions, portion (113), includes a threaded pipe portion (71) for receiving the movable member (1).

Two of the second base portions portions (111), (112) include shaft portions (23), (33) for receiving clamping blocks (5). The other elements on FIG. 41 correspond to the same elements in FIG. 1.

Figure 42:
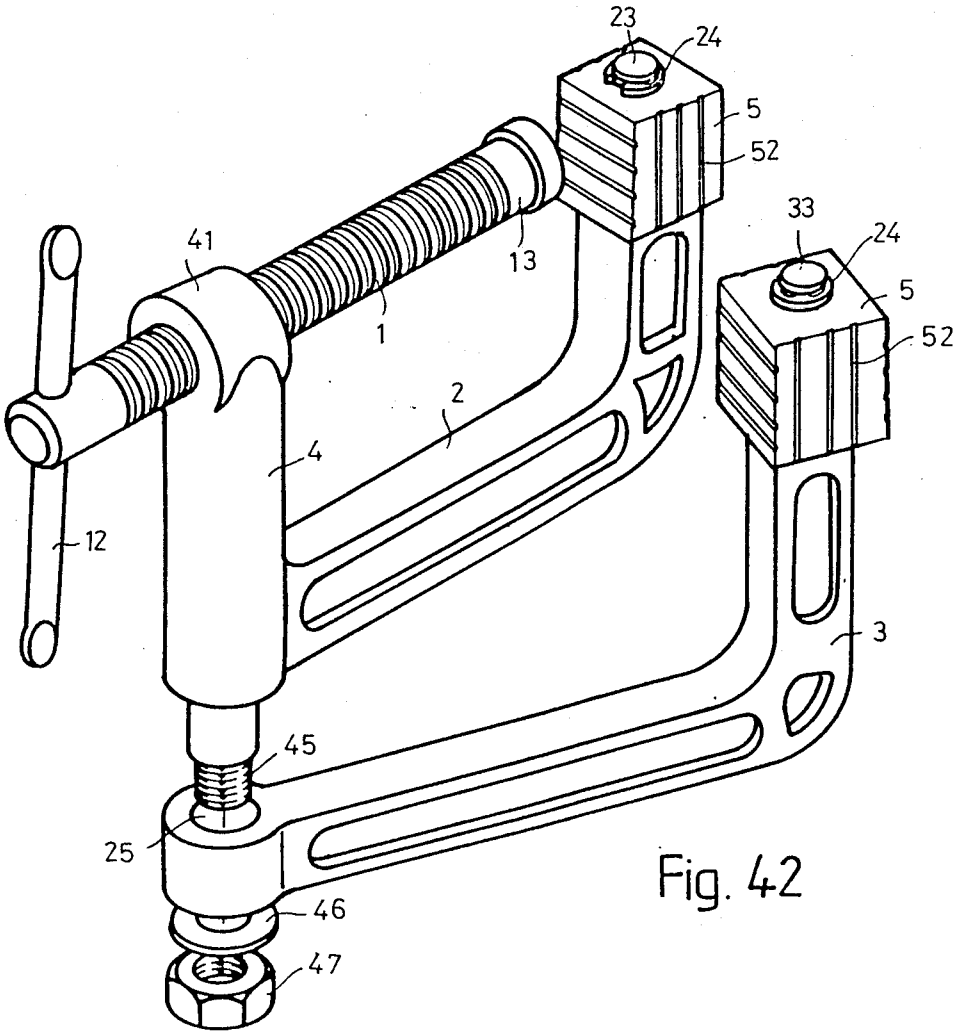
FIG. 42 is the three-dimensional view of an embodiment of the utilization of the overlapped type auxiliary support arm structure.

FIG. 42 is the embodiment of the embodiment of the utilization shown in FIG. 1 in which one of the support arms and the support shaft (4) is joined together to form an integral C-shaped structure, and said support shaft extends downward to be inserted into the motion support arm (3), thus serving as a structure for directional adjustments.

Figure 43:
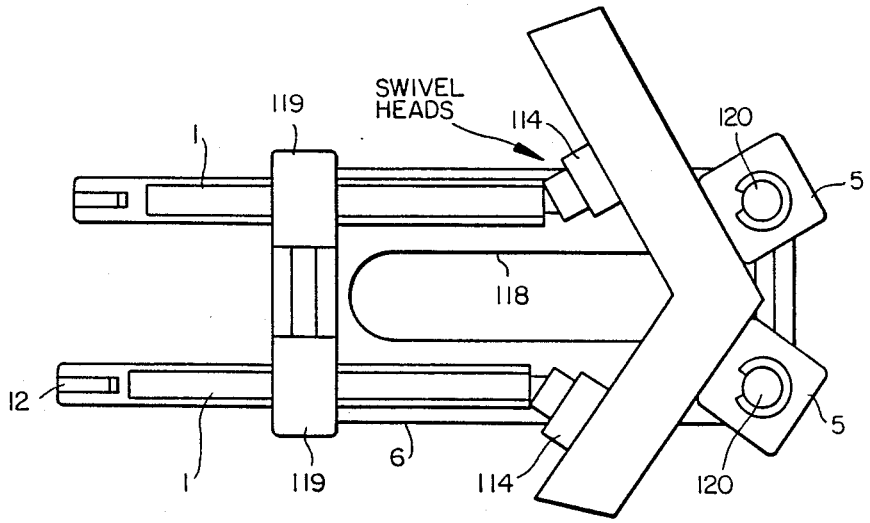
FIG. 43 is a top elevational view of an embodiment having swivel heads located at the ends of dual screws.

In the embodiment shown in FIG. 43, swivel heads (114) are connected to thread movable members (1). A common base (6) has forward and rearward ends. The base has a slot (118) formed therein, facilitating mounting the base on a support such as a table. A first pair of substantially-parallel supports (119) is formed integrally with the forward end of the base transversely thereof. Each of the supports is non-movable relative to one another and has a threaded hole formed therein along an axis substantially transverse thereto. A threaded rod (1) is in each hole. The rods have respective longitudinal axes and extend substantially parallel to each other and to the slot (118) of the base (6). The rods have respective forward and rearward end portions. The forward end portion of each rod extends forwardly beyond the respective upstanding support. A crank handle (12) is pivotably carried by the extending forward end portion of each rod, the handle being pivotable a full 180 degrees. A clamping head is carried by the rearward end of each rod, the clamping heads including freely rotatable swivel heads (114).

A second pair of substantially-parallel spaced-apart upwardly extending supports (120) is formed integrally with the rearward end of the base transversely thereof. Each second support has a respective end portion. Each respective end portion is provided with a shaft (23), (33) thereon. Each of the shafts has a respective longitudinal axis extending substantially parallel to the other respective longitudinal axis and perpendicular to the longitudinal axes of the threaded rods.

A freely rotatable clamping block (5) is carried on each respective shaft end of each respective second support. Each clamping block (5) is substantially uniformly polygonal in cross-section and has a plurality of faces.

Each swivel head (114) is freely rotatable on each rod independently of one another and may be automatically angularly adjusted by a workpiece being clamped in the C-clamp and being spaced from the other. Each clamping block (5) is spaced from the other and is freely rotatable on its respective second support independently of one another and may be automatically angularly adjusted by a workpiece being clamped relative to its respective second support about an axis substantially perpendicular to the longitudinal axis of its respective threaded rod, thereby facilitating the clamping of an irregularly-shaped workpiece in the C-clamp structure. Each swivel head (114) is rotatably retained on one of the rods (1) and each clamping block (5) is rotatably retained on one of the shafts by a retaining means which permits free rotation of the clamp block by the workpiece.

Summing up, improved structure of C-shaped clamp of the present invention not only break through the single functional structure of conventional C-shaped clamp, and but also in the concept of design, it is creative and novel, therefore, its practical function is good and acknowledged. And, in manufacturing the above each embodiment can be individually used or mixed, and further develops its multiple practicability and economy.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A C-clamp structure for clamping a workpiece, comprising:

a threaded movable member including a handle for rotating said movable member, a support shaft for supporting said movable member, said support shaft having a threaded pipe portion for receiving said movable member, said support shaft including means for rigidly engaging L-shaped stationary members and permitting the L-shaped stationary members to be selectively oriented in a rigid orientation with respect to one another, said support shaft including means for preventing said support shaft from rotating with respect to the rigidly oriented L-shaped stationary members, a pair of L-shaped stationary members including first portions extending in substantially parallel planes, said first portions of said L-shaped stationary members including means for rigidly engaging said support shaft, said support shaft engaging means permitting said L-shaped stationary members to be rigidly retained in a selected orientation with respect to one another, said L-shaped stationary members capable of being adjusted with respect to one another by being rotated around said support shaft by disengaging said means for retaining said support shaft in rigid engagement with said L-shaped stationary members, by rotating said L-shaped stationary members with respect to one another, and by re-engaging said means for rigidly engaging said support shaft and said L-shaped stationary members together, said L-shaped stationary members including second portions extending substantially perpendicular to said first portions, said second portions having shaft portions for receiving clamping blocks, clamping blocks attached to said shaft portions of said second portions of said L-shaped stationary members, said clamping blocks capable of rotating around said L-shaped member shaft portions to permit said blocks to engage the workpiece.

2. The C-clamp structure of claim 1, wherein:

said support shaft includes a polygonal outer surface, and said means on said L-shaped stationary members for rigidly engaging said support shaft includes polygonal surfaces which complementarily engage said polygonal outer surface of said support shaft.

3. The C-clamp structure of claim 1, wherein:

said means for retaining said L-shaped stationary members in rigid engagement with said support shaft include a threaded bottom portion of said support shaft and a complementarily threaded nut.

4. The C-clamp structure of claim 1, wherein:

said means for preventing said support shaft from rotating with respect to the rigidly oriented L-shaped stationary members includes rib means located on said support shaft and means for engaging said rib means.

5. The C-clamp structure of claim 1, wherein:

said means for preventing said support shaft from rotating with respect to the rigidly oriented L-shaped stationary members includes rib means located on said support shaft and further includes means for engaging said rib means; and said rib means rigidly engage said rib engaging means when said means for retaining said L-shaped stationary members in rigid engagement with said support shaft are themselves in rigid engagement.

6. The C-clamp structure of claim 5, wherein:

said means for retaining said L-shaped stationary member in rigid engagement with said support shaft include a threaded bottom portion of said support shaft and a complementarily threaded nut.

7. A C-clamp, comprising a support shaft disposed about a longitudinal axis and including an upper portion and further including an intermediate portion having a polygonal cross-section, an internally-threaded sleeve secured on the top portion of the support shaft and arranged substantially at right angles to the longitudinal axis thereof, a screw-threaded rod received within the internally-threaded sleeve, the screw-threaded rod having one end provided with a handle means and further having another end provided with a clamping means, a pair of substantially L-shaped arms including first and second L-shaped arms, each of which has a first member and a second member extending substantially at right angles thereto, each of the first members of the L-shaped arms being disposed below the screw-threaded rod, substantially parallel thereto, and having an end portion provided with a polygonal socket complementary to the polygonal cross-section of the intermediate portion of the support shaft, means for adjustably mounting the L-shaped arms on the intermediate portion of the support shaft in a desired angular relationship relative to one another and about the longitudinal axis of the support shaft, and clamping blocks carried by the second members of the L-shaped arms, respectively, and adapted to cooperate with the clamping means on the screw-threaded rod for clamping a workpiece therebetween.

8. The C-clamp of claim 7, wherein the end portion of the respective first member of one of the L-shaped arms is bifurcated, and wherein the end portion of the respective first member of the other of the L-shaped arms is straddled by the bifurcated end portion of the respective first member of the one L-shaped arm.

9. The C-clamp of claim 7, wherein the respective clamping blocks are freely rotatable on the second members of the L-shaped arms, respectively, and wherein means are provided to retain the clamping blocks on the second members, respectively.

10. The C-clamp of claim 7, wherein the support shaft has a collar keyed thereto above the intermediate polygonal portion of the support shaft, wherein the support shaft has a lower threaded end below the intermediate polygonal section, and wherein a lock nut is received on the lower threaded end of the support shaft.

* * * * *